US007540940B2

(12) United States Patent
Aust et al.

(10) Patent No.: US 7,540,940 B2
(45) **Date of Patent: *Jun. 2, 2009**

(54) MACHINE FOR MAKING/TREATING A SHEET OF MATERIAL

(75) Inventors: Richard Aust, Mönchengladbach (DE); Christoph Henninger, Heidenheim (DE); Stefan Reich, Heidenheim (DE); Martin Tietz, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 264 days.
This patent is subject to a terminal disclaimer.

(21) Appl. No.: 11/484,072

(22) Filed: Jul. 11, 2006

(65) Prior Publication Data

US 2006/0249266 A1 Nov. 9, 2006

Related U.S. Application Data

(60) Division of application No. 11/020,601, filed on Dec. 23, 2004, now abandoned, which is a continuation of application No. PCT/EP03/50209, filed on Jun. 2, 2003.

(30) Foreign Application Priority Data

Jun. 24, 2002 (DE) ..... 102 28 117

(51) Int. Cl.
*D21H 19/84* (2006.01)
*D21H 23/48* (2006.01)
*D21H 25/06* (2006.01)

(52) U.S. Cl. ..... 162/137; 162/136; 162/204; 427/209; 427/326; 427/420

(58) Field of Classification Search ..... 162/204–207, 162/135–137, 265, 361; 118/116–119, 121–123, 118/126, DIG. 4; 427/359, 361, 362, 365, 427/366, 209, 152, 208, 420, 444, 326
See application file for complete search history.

(56) References Cited

U.S. PATENT DOCUMENTS 4,992,411 A * 2/1991 Ohkura ..... 503/200

(Continued)

FOREIGN PATENT DOCUMENTS

CA 2403004 3/2000
WO WO 00/55424 9/2000

*Primary Examiner*—Eric Hug
(74) *Attorney, Agent, or Firm*—Taylor & Aust, P.C.

(57) ABSTRACT

A machine for one of producing and treating, and separately treating a material web including a material web dispensing device, at least one application apparatus, a drying device, a processing device and a material web smoothing device. The material web dispensing device dispenses a material web continuously. The at least one application apparatus is arranged along a material web path after the material web dispensing device. The application apparatus applies a liquid or a pasty application medium to at least one side of the web as it moves along the material web path. The at least one application apparatus including at least one contactless application unit discharging the application medium as a free application medium jet, an application medium curtain, an application medium veil or an application medium droplet spray. The at least one contactless application unit applying the application medium to the material web on the basis of forces imparted to the application medium, movement impulses imparted to the application medium or movement of the application medium induced by the force of gravity. The drying device is arranged along the material web path after the application apparatus. The drying device drying the moving material web to a drying state. The processing device is arranged along the material web path after the drying device. The processing device at least processing, picking up and/or discharging the web. The material web smoothing device is positioned along the material web path either before or after the application apparatus.

13 Claims, 5 Drawing Sheets

U.S. PATENT DOCUMENTS

| | | | | |
|---|---|---|---|---|
| 5,906,865 | A | 5/1999 | Ellermeier et al. | 427/420 |
| 6,063,449 | A | 5/2000 | Koskinen et al. | 427/424 |
| 6,106,902 | A | 8/2000 | Koskinen et al. | 427/424 |
| 6,254,725 | B1 | 7/2001 | Lau et al. | 162/135 |
| 6,468,592 | B1 | 10/2002 | Becker et al. | 427/420 |
| 6,589,388 | B1 | 7/2003 | Nissinen | 162/135 |
| 6,712,931 | B1 | 3/2004 | Gron et al. | 162/128 |
| 7,399,381 | B2 * | 7/2008 | Aust et al. | 162/265 |
| 2005/0011624 | A1 * | 1/2005 | Korhonen et al. | 162/205 |

* cited by examiner

MACHINE FOR MAKING/TREATING A SHEET OF MATERIAL

CROSS REFERENCE TO RELATED APPLICATIONS

This is a division of U.S. patent application Ser. No. 11/020,601, entitled "A MACHINE FOR MAKING/TREATING OF A SHEET OF MATERIAL", filed Dec. 23, 2004, now abandoned, which is a continuation of PCT application No. PCT/EP2003/050209, entitled "MACHINE FOR TREATING A SHEET OF MATERIAL, PREFERABLY MADE OF PAPER OR CARDBOARD, AND FOR OPTIONALLY PRODUCING SAID SHEET OF MATERIAL PRIOR TO THE TREATMENT THEREOF, COMPRISING A CONTACTLESS APPLICATION DEVICE AND A MATERIAL-SMOOTHING DEVICE", filed Jun. 2, 2003.

BACKGROUND OF THE INVENTION

1. Field of the Invention

The invention relates to a machine for producing and treating, or for treating a material web, and, more particularly, to a machine for producing and/or treating paper or paper board.

2. Description of the Related Art

Some papermaking machines permit the production and treatment, including application of an application medium to at least one side of the material web, in what is known as an online operation. In machines of this type, only contacting application apparatuses, such as coating units are conventionally used as the application apparatus.

Other machines may be used for the treatment, including the application of an application medium to at least one side of the material web, in what is known as an offline operation. Machines of this type include coating or application machines separate from a machine for producing the material web, to which the material web to be treated is generally fed in the form of material web reels. Within machines of this type, both contacting application apparatuses, such as coating units, and contactless application apparatuses, such as contactless coating units are used as application apparatuses.

Contacting application apparatuses can be a problem, inasmuch as the performance (runnability) and average operating times between operating interruptions can be impaired as a result of the contacting application or coating. Thus, there is an increased risk of a web break in the application unit resulting in the entire production line coming to a standstill.

As compared with an online operation, the offline operation has a lower volumetric efficiency in relation to the coating of the material web.

For many applications, a material quality with high smoothness and possibly gloss is desired. In order to achieve such a quality, the material web can be calendered online in a smoothing unit, possibly a two-roll soft calender, so as to be machine-finished or more highly machine-finished. Furthermore, there is a large number of material qualities which, conventionally, following the production of the material web in an appropriate machine, or following coating on a coating machine, have to be calendered offline in a further operation. Calendering exerts a substantial influence on the surface structure of the material, in particular of paper or board, and therefore both on the visual appearance and on the printability. Calendering is a very important operation for coated papers. Following coating, it provides smoothness and possibly gloss.

If the coating is carried out in an offline operation, the calendering is conventionally carried out in a separate offline process by way of a suitable smoothing machine, for example, a supercalender or soft calender, separate from the coating machine. On account of two offline processes being carried out, one after another, by way of separate machines, the result is an even lower volumetric efficiency.

What is needed in the art is a machine which has good performance and runnability and is able to provide material with a high smoothness and possibly gloss with a good volumetric efficiency.

SUMMARY OF THE INVENTION

The present invention comprises, in one form thereof, a machine having an application device with at least one contactless application unit. The unit is designed to discharge application medium in at least one free application medium jet or an application medium curtain or an application medium veil or in an application medium droplet spray and to apply it to the material web on the basis of forces and/or movement impulses imparted to the application medium and/or on the basis of a movement of the application medium induced by the force of gravity. Further, a material web smoothing device is provided along the treatment path before and/or after the application device. In addition to an application on the basis of the force of gravity, an application on the basis of electrostatic forces is to be considered.

According to one embodiment of the present invention there is a contactless application of the application medium to at least one side of the material web, in particular a contactless coating of one or both sides of the material web is made possible in an online operation or in an offline operation in the machine, in particular a papermaking machine. The material web smoothing device is integrated into the machine to ensure high smoothness and possibly gloss of the material on one side or both sides of the material web.

If the machine does not also produce the material web, that is to say the application of a coating and smoothing thereof are carried out in an offline operation, the result is a considerably increased volumetric efficiency because the smoothing device and the application apparatus are integrated into one machine, so that both a application of coating to the web and smoothing of the web are carried out in an offline process.

If the machine is also used for producing the material web that is to be treated, such as coating or smoothing procedures, in an online process, there are certain advantages. Moreover, with regard to the application of the application medium, to a certain extent the advantages of conventional contacting coating in an online operation and of a conventional contactless coating in an offline operation are obtained in combination. Specifically, on the one hand the higher volumetric efficiency of an online operation and the better runnability of the contactless coating, conventionally used only in an offline operation. According to the present invention, the high smoothness and possibly the gloss of the material are achieved by way of the material web smoothing device.

The machine has a material web smoothing device along the material web path, at least before the application device. Connecting the material web smoothing upstream of the application of the application medium is expedient and effective inasmuch as contactless application methods, in particular coating methods, largely maintain the contour of the material web surface (in this connection, one speaks of "contour coating methods"). This means that a rough contour of the material web is not evened out/or smoothed, or if it is smoothed it is only comparatively little, by the application medium. The smoother the material web is before the application of the application medium, the higher is the level of achieved product quality. In this connection, it has been shown that it is better to smooth first and then to apply the contour coating than to smooth a rough contour after the coating.

It has proven to be beneficial if the material web smoothing device is designed to calender the material web, at least on one side, in such a way that a material web roughness of no more than between 5 μm, and preferably at most 3 μm, remains. These material web roughness values preferably relate to values determined by way of the PPS method (Parker PrintSurf): roughness (PPS-10s) of ≦5 μm, or preferably ≦3 μm.

With regard to the material web smoothing device or the material web roughness achieved by the latter, these roughness values are achieved on the basis of normal operating parameters of the machine.

In addition, a material web smoothing device can also be provided along the material web path after the application apparatus. For example, in order to achieve a particularly high smoothness or a particularly high gloss. For many applications, however, a material web smoothing device before the application device will be able to ensure a sufficient smoothness or sufficient gloss.

The material web smoothing device can advantageously have a smoothing unit from the group consisting of a soft nip calender, a wide nip calender, a hard nip calender, a supercalender, a multi-nip smoothing unit (e.g. Janus), a 1-nip calender, and a 2-nip calender.

With regard to the application of the application medium, use is made of what is known as a curtain application method, also known as curtain coating. For this purpose, it is proposed that at least one contactless application unit, designed as a curtain application unit, be provided, which discharges the application medium in the form of at least a curtain or veil onto the material web. The application is, at least predominantly, on the basis of a movement of the application medium induced by the force of gravity. Alternatively, use can also be made of what is known as a spray application method, also known as a spray coating. For this purpose, at least one contactless application unit, designed as a spray application unit, is provided, which discharges the application medium in the form of an application medium droplet spray or application medium jets on the material web. The application is, at least predominantly, on the basis of movement impulses imparted to the application medium as it emerges from a nozzle arrangement.

The curtain application method is preferred over the spray application method since, on the basis of the curtain application method, a higher product quality is achieved and the curtain application method generally entails less maintenance than the spray application method.

The machine, according to the present invention, can have at least one further material web treatment device. Such a further material web treatment device can be arranged along the material web path between the material web forming device and the dewatering and drying section; or between the dewatering and drying section and the application apparatus; or between the application apparatus and the drying device; or between the drying device and the device for processing and/or picking up and/or discharging the material web; or integrated into the material web forming device; or the dewatering and drying section, or the application apparatus, or the drying device, or the device for processing and/or picking up and/or discharging the material web.

As already mentioned, the machine according to the present invention can also be used for producing the material web. To this end, the material web dispensing device comprises a material web forming device, which is designed to form the material web continuously from raw material supplied, preferably from a fibrous suspension. As a rule, a dewatering and drying section is then arranged along the fiber material web path between the material web forming device and the application apparatus, which is designed to extract water from the moving material web, at least by way of thermal and/or mechanical action, and to dry the material web at least down to a residual moisture content. The material web smoothing device is arranged along the material web path before the application device and is particularly arranged between the dewatering and drying section, and the application device, or integrated into a drying section portion of the dewatering and drying section. In this connection, it is entirely possible for at least one further material web treatment device to be arranged along the material web path between the material web forming device and the dewatering and drying section; or between the dewatering and drying section and the application apparatus. The material web smoothing device according to the present invention can be connected upstream and downstream, as appropriate, or integrated into the material web performing device on the dewatering and drying section. However, the machine can also be a machine which carries out the medium application and the smoothing of the material web in an offline process. For this configuration the material web dispensing device can include a material web unwind for unwinding the material web from a respective material web reel. The above-mentioned material web smoothing device is arranged along the material web path, before the application device, and is generally arranged between the material web unwind and the application apparatus. It is entirely possible for at least one further material web treatment device to be provided, which is arranged along the material web path between the material web unwind and the application apparatus and, in this case, for the material web smoothing device is connected upstream or downstream, as appropriate, or integrated into the material web unwind.

It should further be mentioned that the contactless application by way of an appropriate application device is also advantageous, in particular when application medium is applied to the moving material web at a plurality of application points in the machine. The material web is less stressed by the contactless application of the application medium than by a contacting application, so the risk of web breaks is reduced and, accordingly, the performance or runnability is improved.

Another embodiment of the present invention also relates to the use of a contactless application unit, in particular a curtain application unit or spray application unit, for applying liquid or pasty application medium to a moving material web, preferably of paper or board, and the use of a material web smoothing device for smoothing the moving material web. According to the present invention, the contactless application unit and the material web smoothing device are used in combination. They are used in an online process within a machine for producing and treating the material web, or in an offline process within a machine for treating the material web. In either process they first apply a liquid or pasty application medium to a moving material web, preferably of paper or board, and secondly they smooth the material web or provide it with gloss.

Moreover, the present invention provides a method for treating a material web, preferably of paper or board. According to the present invention, the method includes at least the following steps:

contactless application of a liquid or pasty application medium to at least one side of the moving material web, before and/or after the contactless application: smoothing of at least one side of the material web, and drying of the material web.

Regarding the implementation of the method, thought is given in particular to the following sequence, if necessary, first drying, then smoothing, then if appropriate drying once more, then application in a contactless manner, then drying and then if appropriate smoothing once more.

Inter alia, the invention proposes coating in a contactless manner in an integrated process and smoothing by way of a suitable smoothing unit, in particular a calender, it being possible for the smoothing to be carried out before or after the coating. Smoothing by way of a calender before coating replaces a conventional smoothing unit, so that a particularly good base for coating is achieved, and also an improvement in the final quality, exemplified by high smoothness or high gloss, that is achieved in the integrated process. As a result of applying the curtain coating application to a very smooth raw material, a very smooth end product is achieved. The smoothing, according to the present invention, before and/or after the coating application is of particular importance since the coating quality depends on the quality of the raw material (body paper).

Relative to the contactless application of application medium, in particular the contactless coating, thought is primarily given to an application of the application medium such that, first, the application is carried out without contact and, second, no metering and preferably no equalization of the application medium applied, by way of a doctor device or the like, is required. The application of the application medium is preferably carried out from the start both with the correct metering and with adequate uniformity over the surface of the material web. This means that the application to the material web is not carried out in excess, which is what is known as a 1-to-1 application.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
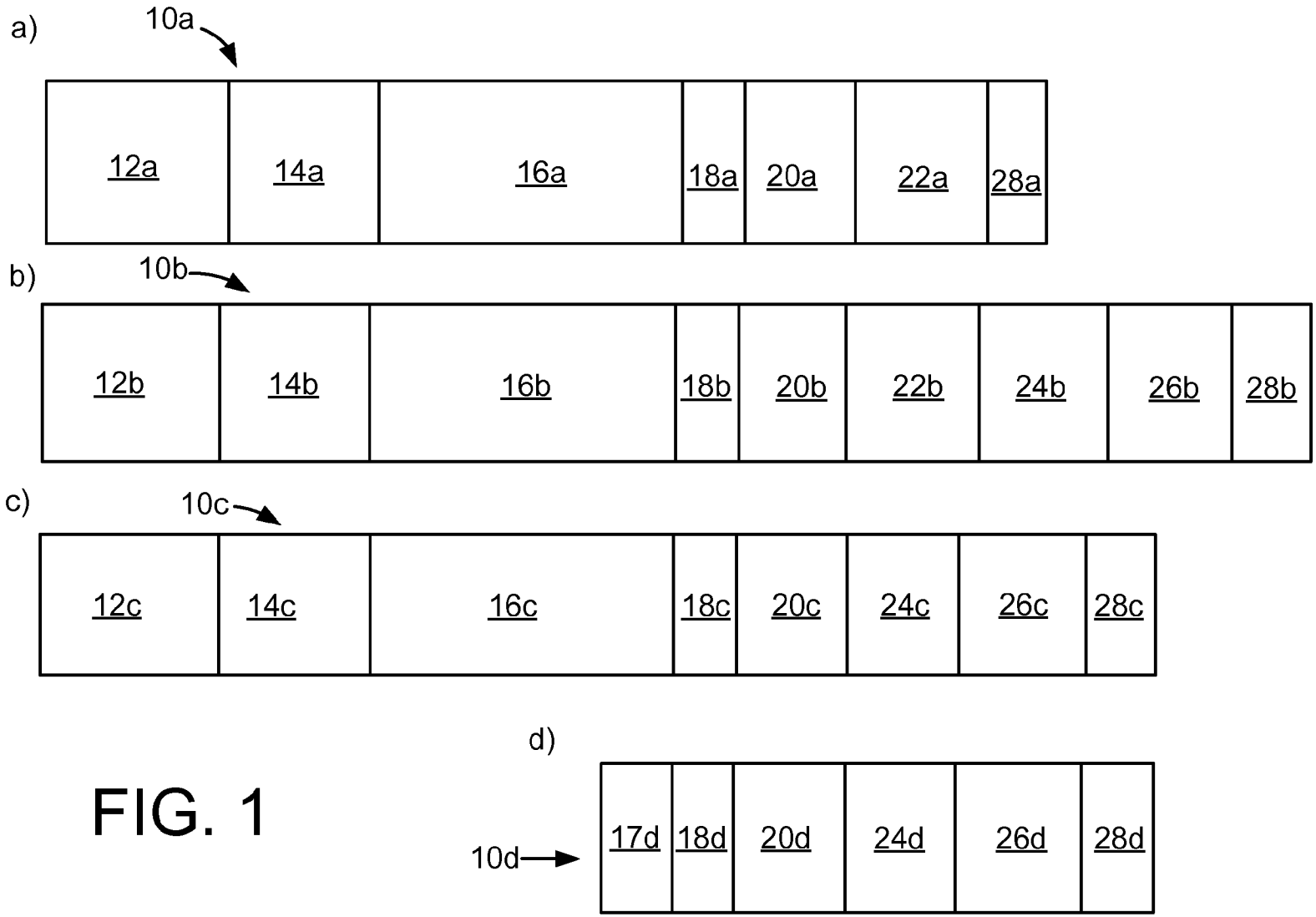
FIG. 1 shows in schematic form four examples of possible configurations of a machine according to the present invention for producing and treating a material web of paper or board (FIGS. 1*a*, 1*b*, 1*c*) and, respectively, a machine according to the present invention of treating an otherwise produced material web of paper or board (FIG. 1*d*)

Referring now to the drawings, and more particularly to FIGS. 1*a*, 1*b* and 1*c* each show an example of a papermaking machine according to the present invention in a very schematic form. This can be, for example, a Fourdrinier papermaking machine or the like. Papermaking machine 10*a*, 10*b* or 10*c* has a wet end 12*a*, 12*b* or 12*c* with an associated flow box and an associated stock supply system. The stock supply system is designed to supply a fibrous suspension to the flow box with a constant volume flow. The flow box and the wet end are used for web formation by way of uniform fiber distribution and dewatering, as well as for web guidance. Along a material web path, section 12*a*, 12*b* or 12*c*, is followed by a press section 14*a*, 14*b* or 14*c*, which is used in particular to ensure mechanical dewatering of the material web by pressing the material web. Along the material web path, the press section is followed by a drying section 16*a*, 16*b* or 16*c*, in which the material web is dried in a thermal manner, also known as thermal dewatering.

According to the examples of FIG. 1, after the drying section, there is arranged a material web smoothing device 18*a*, 18*b* or 18*c*, which is what is known as a calender (for example a soft nip calender or wide nip calender) or a smoothing unit of another suitable type.

In each of the embodiments, along the material web path, after the smoothing unit, a contactless coating unit 20*a*, 20*b* or 20*c* is arranged, such as an application apparatus, preferably what is known as a curtain application unit. The curtain application unit applies application medium, in particular a coating medium, to one side of the material web in a contactless manner. In the case of the curtain application unit the application of coating medium is, at least predominantly, on the basis of a movement induced by the force of gravity of the application medium emerging from a slot nozzle or the like in what is known as a curtain or veil. The application takes place either to that side of the material web, which can be identified as the top side, at least over the major part of the entire material web path; or to that side of the material web which can be identified as the underside of the material web, at least over the major part of the entire material web path, but may possibly be oriented upwards in some regions in the area of the application unit.

Application unit or coating unit 20*a* or 20*b* is followed by a final drying section 22*a* or an intermediate drying section 22*b*, while coating unit 20*c* is followed by a further coating unit 24*c*, which applies medium to the other side of the material web and which, just like coating unit 20*c*, applies coating medium to the material web in a contactless manner.

According to the example of FIG. 1*b*, a further coating unit 24*b* is arranged after intermediate drying section 22*b*.

Along the material web path, coating unit 24*b* or 24*c* is followed by a final drying section 26*b* or 26*c* and, at the end of the material web path, there is in all three examples, a material web reel-up 28*a*, 28*b* or 28*c*, which is used to reel up the material web coated on one or both sides on what are known as spools.

Now, additionally referring to FIG. 1*d*, a coating machine according to the present invention is shown in a very schematic illustration. Coating machine 10*d* has a material web unwind 17*d* in which the material web, to be treated, is unwound from material web reels. The unwound material web is fed to a material web smoothing device 18*d*, for example, what is known as a calender, such as a soft nip calender or a wide nip calender, or a smoothing unit of another suitable type, before the material web is coated on both sides with application medium by way of contactless coating units 20*d*, 24*d*. The configuration of machine 10*d* to this extent corresponds to the configuration of machine 10*c* according to FIG. 1*c*, since no intermediate drying is provided between the medium applications. Coating unit 24*d* is followed by drying section 26*d* and, at the end of the material web path, there is a material web reel-up 28*d*.

Figure 2:
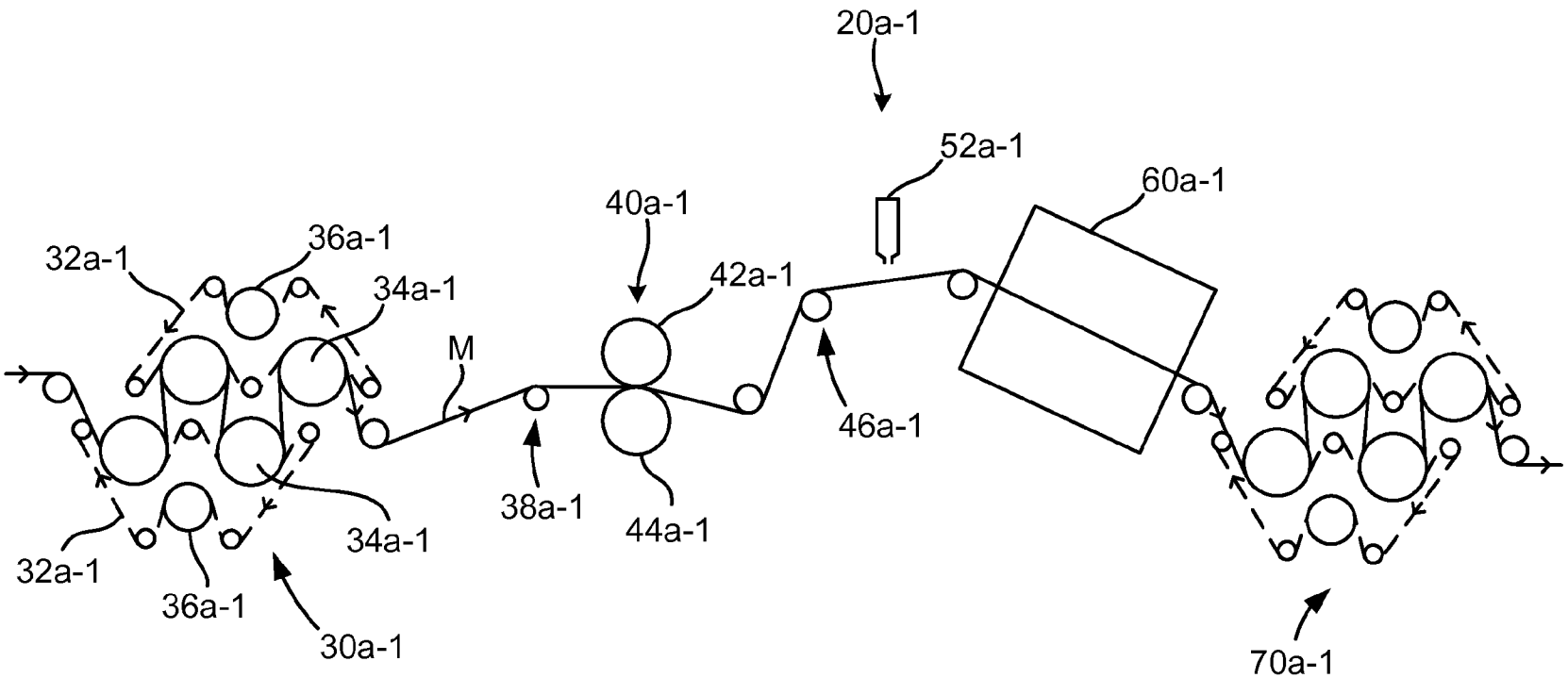
FIG. 2 represents a section of a machine corresponding to FIG. 1*a* according to a first embodiment of a machine according to the present invention having an application apparatus permitting the contactless application of application medium, specifically to a top side of the material web.

FIG. 2 shows an example of a possible implementation of machine 10*a* according to FIG. 1. A drying device 30*a*-1 of drying section 16*a*, is used for the thermal drying of material web M by way of circulating belts 32*a*-1, which press material web M against heatable drying cylinders 34*a*-1, on which material web M is subjected to what is known as contact drying. In each case a drying cylinder 36*a*-1, used for drying the felt, is assigned to felts 32*a*-1.

Material web M emerging from drying device 30*a*-1 is led over a guide roller arrangement 38*a*-1, through a smoothing unit 40*a*-1. Smoothing unit 40*a*-1 belongs to material web smoothing device 18*a*, which is represented by smoothing rolls 42*a*-1 and 44*a*-1 acting on both sides of material web M. This can be, for example, what is known as a soft nip smoothing unit or a wide nip smoothing unit.

Material web M is led over a further guide roll arrangement 46*a*-1 through an application apparatus 20*a*-1, which has a curtain application unit that is represented by a discharge head 52*a*-1. Discharge head 52*a*-1 discharges application medium in a metered manner in the form of an application medium veil or application medium curtain, which strikes the top side of material web M on the basis of the movement of the force of gravity and remains on this side of material web M without further metering and equalization, thereby providing the desired application or coating. Discharge head 52*a*-1 can advantageously be assigned some edge guiding elements, or the like, for the curtain or the veil, as known from the prior art, see for example, German patents DE 100 12 256 A1, DE 197 35 588 A1 and DE 195 13 531 A1.

Material web M that has been coated with the application medium then enters a convection or hot air dryer 60*a*-1, as an example of a contactless drying device. In drying 60*a*-1 material web M and the application medium applied thereto is dried to such an extent that subsequently, by way of a further drying device 70*a*-1 of the type of drying device 30*a*-1, contact drying of material web M can be carried out without quality penalties. Drying device 70*a*- 1, together with dryer 60*a*-1, belong to final drying section 23*a*.

As can be seen from FIG. 1*a*, final drying section 22*a* is followed by material web reel-up 28*a* However, still further material web treatment devices could quite possibly be connected upstream of the material web reel-up, for example a further smoothing unit.

Figure 3:
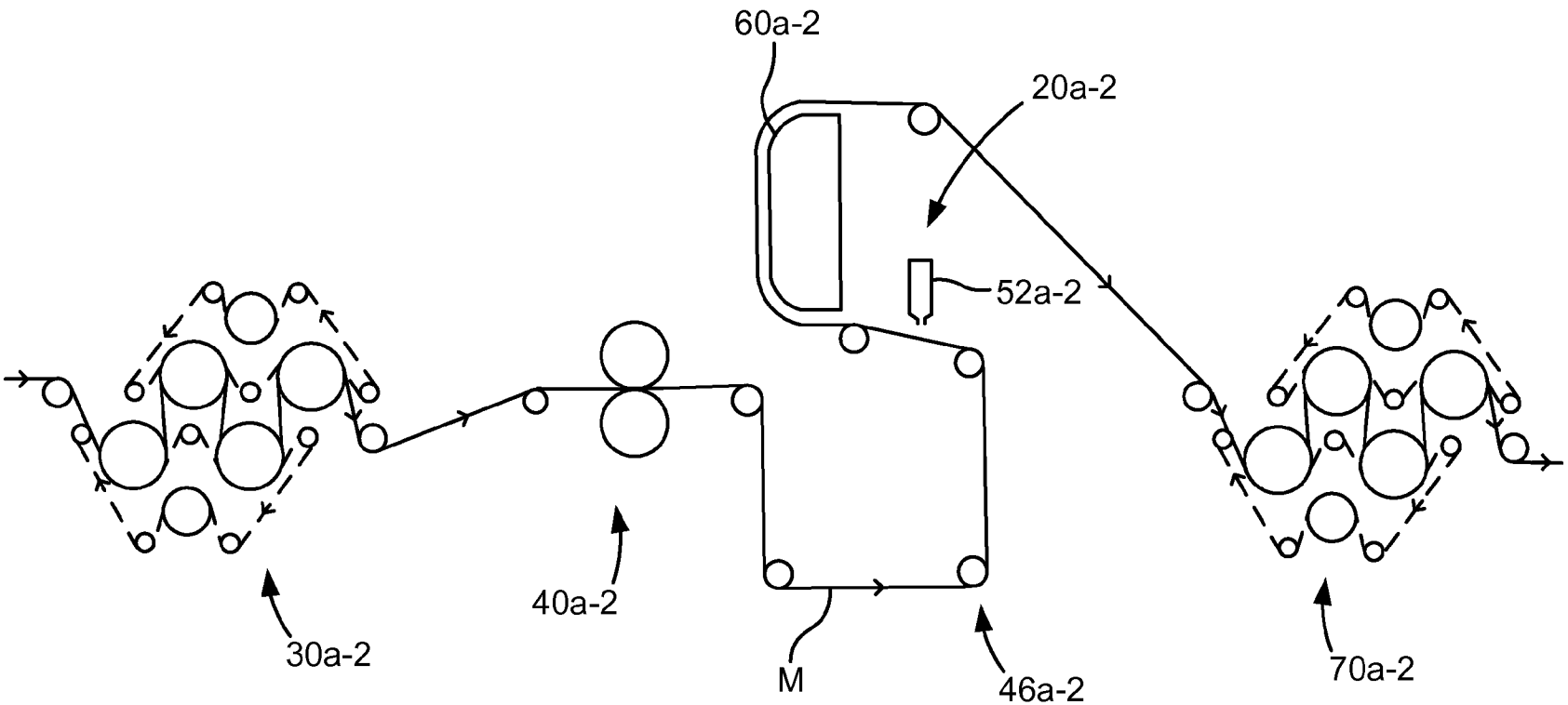
FIG. 3 represents a section of a machine corresponding to FIG. 1*a* according to another embodiment of a machine according to the present invention having an application apparatus permitting the contactless application of application medium, specifically to an underside of the material web.

A further implementation of machine 10*a* according to FIG. 1*a* is shown in FIG. 3. There is illustrated a drying device 30*a*-2 of the type of drying device 30*a*-1 according to FIG. 2, a smoothing unit 40*a*-2 corresponding to smoothing unit 40*a*-1 according to FIG. 2, and an application apparatus 20*a*-2 whose curtain application unit is again represented by a discharge head 52*a*-2. Material web M is guided over a guide roll arrangement 46*a*-2 in such a way that, as compared with the example of FIG. 2, the upper material web side is provided with an application of medium without contact. Again, discharge head 52*a*-2 can be assigned edge guiding elements, and the like, for the curtain or veil of application medium.

By way of a contactless drying device 60*a*-2 which, in addition to a contactless drying function on the basis of hot air, additionally fulfills a contactless guiding and deflection function in relation to material web M. The deflection is carried out in a manner similar to that, which is known as an air turn. Material web M is then fed to further drying device 70*a*-2 of the type of drying device 30*a*-1 according to FIG. 2 which, together with drying device 60*a*-2, is included in final drying section 22*a*.

Figure 4:
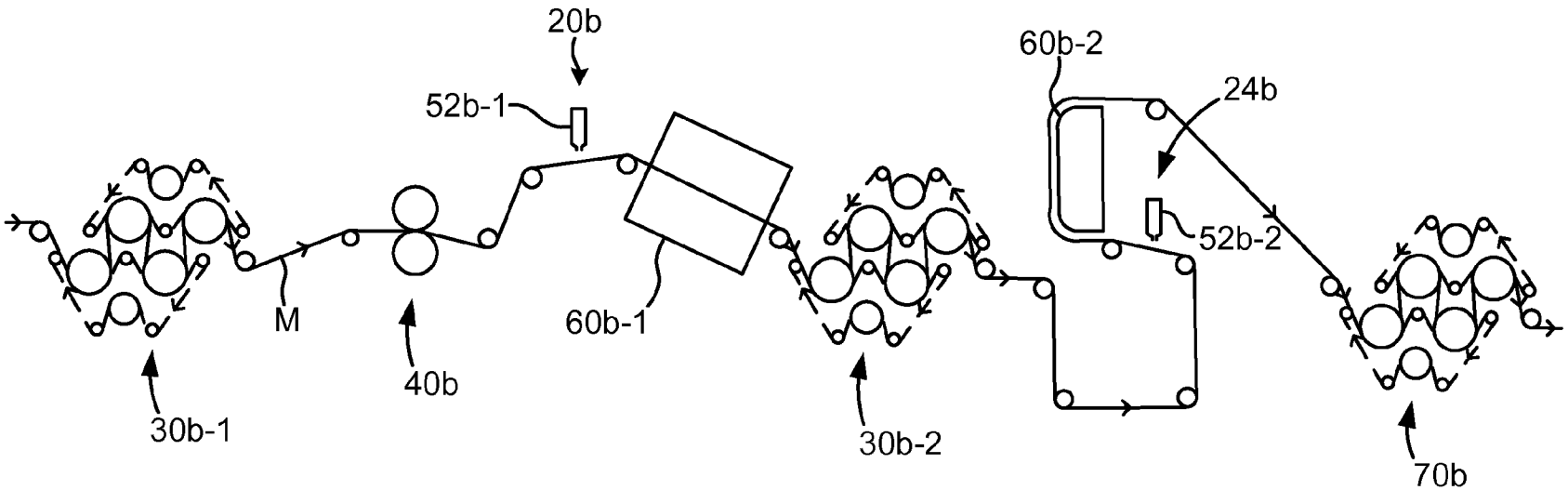
FIG. 4 represents a section of a machine corresponding to FIG. 1*b* according to another embodiment of a machine according to the present invention having application apparatuses permitting the contactless application of application medium, specifically to both sides of the material web.

A configuration corresponding to FIG. 1*b* can be obtained, for example, by a machine section corresponding to FIG. 2 and a machine section corresponding to FIG. 3 being arranged one after another in a machine. FIG. 4 shows a corresponding example. In the material web running direction, it is possible to see, one after another, a drying device 30*b*-1, a smoothing unit 40*b*, an application apparatus 20*b* having a curtain application unit represented by a discharge head 52*b*-1, a contactless dryer 60*b*-1, a further contact drying device 30*b*-2, an application apparatus 24*b* having a curtain application unit represented by a discharge head 52*b*-2, a contactless drying and guide or deflection device 60*b*-2 and a further contact drying device 70*b*. Dryer 60*b*-1 and drying device 30*b*-2 form intermediate drying section 22*b* according to FIG. 1*b*.

Figure 5:
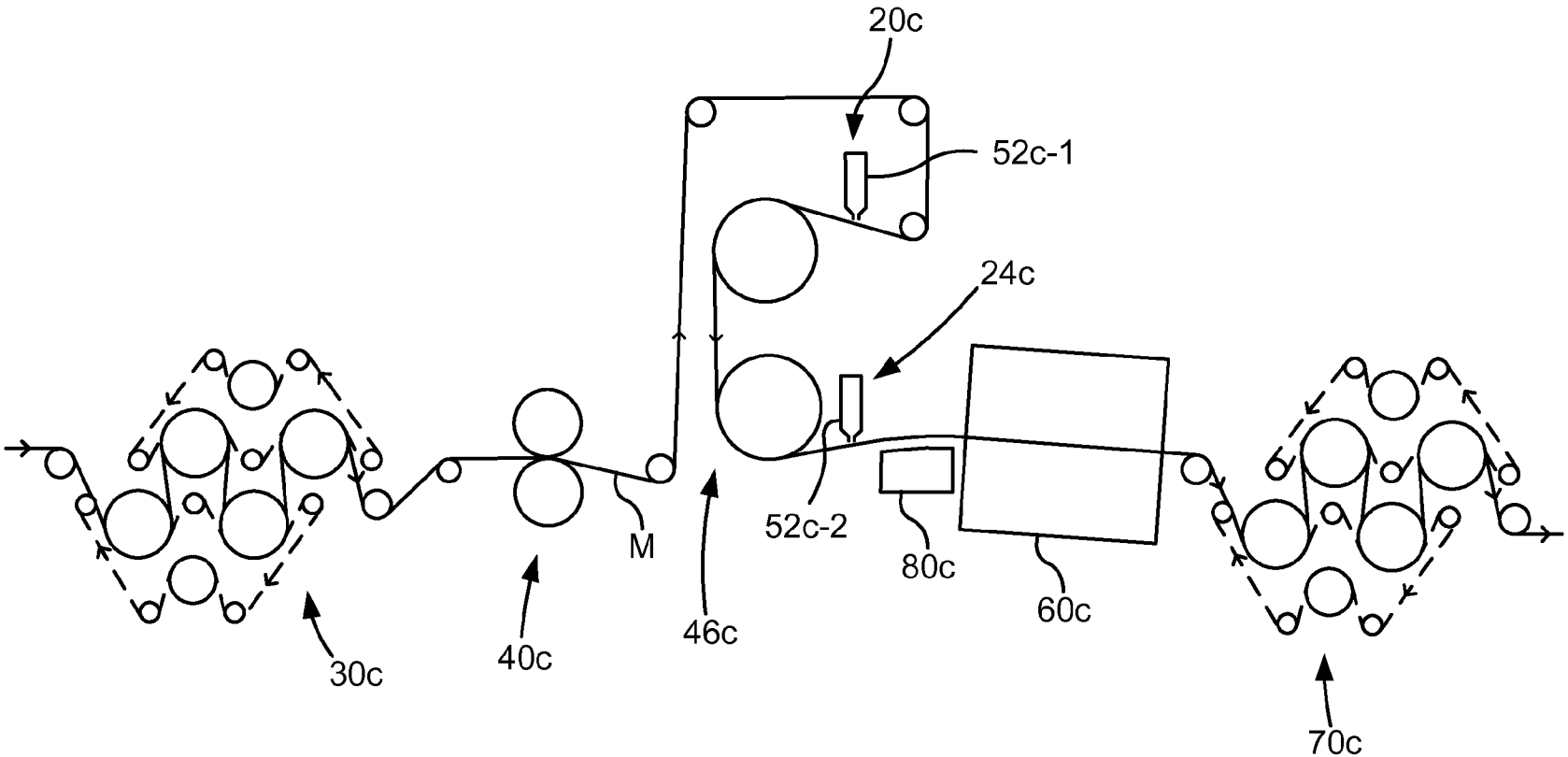
FIG. 5 represents a section of a machine corresponding to FIG. 1*c* according to yet another embodiment of a machine according to the present invention having an application apparatus permitting the contactless application of application medium, specifically to both sides of the material web.

If an application of application medium to both sides of material web M is desired, then, given appropriate guidance of material web M, the application medium is first applied to both sides of material web M by way of a corresponding contactless application unit before contactless drying and then, finally, contact drying is carried out. It is therefore not absolutely necessary to provide intermediate drying between the application of the application medium to one side of material web M and the application of the application medium to the other side of material web M. FIG. 5 shows a corresponding example, which corresponds to an implementation of a machine of the configuration according to FIG. 1*c*. The machine includes a contact drying device 30*c*, corresponding to device 30*a*-1, a smoothing unit 40*c*, a first curtain discharge head 52*c*-1 belonging to a first contactless application apparatus 20*c*, a second discharge head 52*c*-2 belonging to a second contactless application apparatus 24*c*, a contactless dryer 60*c* and a further contact drying device 70*c* corresponding to device 30*a*-1 according to FIG. 2. From smoothing unit 40*c*, material web M is led over a guide roll arrangement 46*c*. First web M is led under first discharge head 52*c*-1 and then under second discharge head 52*c*-2, in such a way that the first discharge head 52*c*-1 applies the application medium to one side of material web M and second discharge head 60*c*-2 applies the application medium to the other side of material web M in a metered manner in the form of a curtain or veil and without requiring subsequent equalization. After second discharge head 50*c*-2, an air guide arrangement 80*c* is provided, which ensures guidance of material web M with no contact on either side into dryer 60*c* and through the latter as far as the entry into contact drying device 70*c*.

A configuration corresponding to FIG. 1*d* is illustrated by using FIG. 5. It is possible to think of drying device 30*c* merely replaced by a material web unwind. Material web M is unwound from a material web reel and is fed first to smoothing unit 40*c* and then coated on both sides in contactless application apparatuses 20*c* and 24*c*. In the contactless dryer, drying without contact is carried out, in particular by way of hot air and/or by way of infrared radiation, before material web M is brought to a final state of dryness on both sides with contact in drying device 70*c*. After that, material web M is then reeled up onto spools in the material web reel-up, not illustrated, if no further treatment in an appropriate treatment device, for example further smoothing in an appropriate additional material web smoothing device, is provided.

Inter alia, it is proposed, in a machine for producing and treating a material web, preferably of paper or board, to provide at least one application device having at least one contactless application unit in combination with at least one material web smoothing device, which, firstly, permit the application of a liquid or pasty application medium to at least one side of the moving material web in a contactless manner and, secondly, smoothing of the moving material web, preceding and/or following the application of medium, in an online process or in an offline process.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

10*a*, 10*b*, 10*c* Papermaking machine
12*a*, 12*b*, 12*c* Wet end
14*a*, 14*b*, 14*c* Press section
16*a*, 16*b*, 16*c* Drying section
17*d* Material web unwind
18*a*, 18*b*, 18*c*,
18*d* Material web smoothing device
20*a*, 20*b*, 20*c*,
20*a*-1, 20*a*-2,
20*d* Application apparatus or coating unit
22*a* Final drying section
22*b* Intermediate drying section
24*b*, 24*c*, 24*d* Application apparatus or coating unit
26*b*, 26*c*, 26*d* Final drying section or drying section
28*a*, 28*b*, 28*c*,
28*d* Material web reel-up
30*a*-1, 30*a*-2,
30*b*-1, 30*b*-2,
30*c* Drying device
32*a*-1 Felt
34*a*-1, 36*a*-1 Drying cylinder
38*a*-1 Guide roller arrangement
40*a*-1, 40*a*-2,
40*b*, 40*c* Smoothing unit
42*a*-1, 44*a*-1 Smoothing roll
46*a*-1, 46*a*-2,
46*c* Guide roller arrangement
52*a*-1, 52*a*-2,
52*b*-1, 52*b*-2,
52*c*-1, 52*c*-2, Curtain discharge head
60*a*-1, 60*a*-2,
60*b*-1, 60*b*-2,
60*c* Drying device (contactless)
70*a*-1, 70*a*-2,
70*b*, 70*c* Drying device
80*c* Air guide device
M Material web

What is claimed is:

1. A method of coating a fiber material web, comprising the of:

using a contactless application unit that is a first curtain application unit to apply one of a liquid and a pasty application medium to a side of a moving fiber material web in combination with a material web smoothing device in an online process within a machine for producing and treating the fiber material web; and using a second curtain application unit to apply one of a liquid and a pasty application medium to an opposite side of the moving fiber material web without an intermediate drying step between the first curtain application unit and the second curtain application unit.

2. A method for treating a fiber material web, comprising the steps of:

contactlessly applying one of a liquid and pasty application medium using a first curtain application unit to a side of the fiber material web as it moves;

smoothing at least one side of the fiber material web one of before and after said contactlessly applying step;

drying the fiber material web; and contactlessly applying one of a liquid and pasty application medium using a second curtain application unit on an opposite side of the fiber material web as it moves without an intervening drying step occurring between the two contactlessly applying steps.

3. the method of claim 2, wherein the method is sequentially carried out as follows:

said smoothing step;

both of said contactlessly applying steps; then said drying step.

4. The method of claim 2, wherein said drying step is at least additionally carried out one of prior to said smoothing step and after said smoothing step.

5. The method of claim 2, wherein said smoothing step is additionally carried out after said drying step.

6. The method of claim 2, wherein said smoothing step smoothes the fiber material web on at least one side such that a fiber material web roughness is no greater than 5 μm when measured in accordance with the PPS-10s measuring method.

7. The method of claim 6, wherein said roughness is no greater than 3 μm.

8. The method of claim 6, wherein said material web smoothing device achieves said fiber material web roughness of at most 5 μm on the basis of normal operating parameters of the machine.

9. The method of claim 8, wherein said fiber material roughness is at most 3 μm.

10. The method of claim 1, further comprising a smoothing step using said smoothing device to smooth the fiber material web on at least one side such that a fiber material web roughness is no greater than 5 μm when measured in accordance with the PPS-10s measuring method.

11. The method of claim 10, wherein said roughness is no greater than 3 μm.

12. The method of claim 10, wherein said smoothing device achieves said fiber material web roughness of at most 5 μm on the basis of normal operating parameters of the machine.

13. The method of claim 12, wherein said fiber material roughness is at most 3 μm.

* * * * *